US010962011B2

(12) United States Patent
Lupi

(10) Patent No.: US 10,962,011 B2
(45) Date of Patent: Mar. 30, 2021

(54) SCROLL COMPRESSOR WITH INTEGRATED REFRIGERANT PUMP

(71) Applicant: SCHNEIDER ELECTRIC IT CORPORATION, West Kingston, RI (US)

(72) Inventor: Raffaele Giovanni Lupi, Padua (IT)

(73) Assignee: SCHNEIDER ELECTRIC IT CORPORATION, Foxboro, MA (US)

( * ) Notice: Subject to any disclaimer, the term of this patent is extended or adjusted under 35 U.S.C. 154(b) by 191 days.

(21) Appl. No.: 16/215,706

(22) Filed: Dec. 11, 2018

(65) Prior Publication Data

US 2019/0203717 A1 Jul. 4, 2019

(30) Foreign Application Priority Data

Dec. 29, 2017 (IT) ..... 1020170151025

(51) Int. Cl.
*F04C 29/00* (2006.01)
*F04C 28/06* (2006.01)
(Continued)

(52) U.S. Cl.
CPC ..... *F04C 29/0064* (2013.01); *F04C 18/02* (2013.01); *F04C 18/0215* (2013.01);
(Continued)

(58) Field of Classification Search
CPC .... F04C 18/02; F04C 18/0215; F04C 23/008; F04C 28/06; F04C 29/005; F04C 29/0064;
(Continued)

(56) References Cited

U.S. PATENT DOCUMENTS 7,418,824 B2 * 9/2008 Uno ..... F01C 11/004 62/238.6
7,836,696 B2 * 11/2010 Uno ..... F01K 23/065 60/670
(Continued)

FOREIGN PATENT DOCUMENTS

JP 2012013029 A 1/2012

OTHER PUBLICATIONS

Extended European Search Report from corresponding European Application No. 18213470.0 dated May 28, 2019.
(Continued)

*Primary Examiner* — Mary Davis
*Assistant Examiner* — Paul W Thiede
(74) *Attorney, Agent, or Firm* — Lando & Anastasi, LLP

(57) ABSTRACT

A cooling system is configured to operate in one of three modes, a DX mode of operation when outdoor air is too hot or too humid and the cooling system operates as a normal closed circuit system, a hybrid mode of operation when outside temperatures cool down and the cooling system operates as a partial reduced normal closed circuit system and a free cooling system, and a thermosiphon mode of operation when the outside temperature is below a predetermined temperature and the cooling system operates without the normal closed circuit system. The cooling system includes a scroll compressor unit having a main casing, a scroll compressor supported by the main casing, and a refrigerant pump supported by the main casing. The scroll compressor unit is configured to selectively engage the scroll compressor and the refrigerant pump to achieve one of the DX mode, the hybrid mode, and the thermosiphon mode.

11 Claims, 4 Drawing Sheets

(51) Int. Cl.

| | |
|---|---|
| ***F25B 1/04*** | (2006.01) |
| ***F04C 23/00*** | (2006.01) |
| ***F04C 18/02*** | (2006.01) |
| ***F25B 31/02*** | (2006.01) |

(52) U.S. Cl.
CPC ..... *F04C 23/008* (2013.01); *F04C 28/06* (2013.01); *F25B 1/04* (2013.01); *F25B 31/02* (2013.01); *F04C 29/005* (2013.01); *F25B 2400/0401* (2013.01); *F25B 2600/0251* (2013.01); *F25B 2600/13* (2013.01)

(58) Field of Classification Search
CPC .. F04C 11/003; F25B 1/04; F25B 2400/0401; F25B 2600/0251; F25B 2600/13; F25B 31/02; F25B 1/047; F01K 23/065; F01C 11/008
USPC ..... 418/55.1–55.6, 69; 62/238.6, 498, 527; 417/410, 411; 60/670
See application file for complete search history.

(56) References Cited

U.S. PATENT DOCUMENTS

| | | | | |
|---|---|---|---|---|
| 7,992,400 | B2 * | 8/2011 | Uno | F01C 20/26 62/238.6 |
| 2005/0235670 | A1 * | 10/2005 | Takeuchi | F01C 11/008 62/238.6 |
| 2006/0196204 | A1 * | 9/2006 | Takeuchi | F04C 11/003 62/238.6 |
| 2006/0254309 | A1 * | 11/2006 | Takeuchi | F01K 23/02 62/501 |
| 2010/0094465 | A1 | 4/2010 | Chessel et al. | |
| 2013/0098086 | A1 | 4/2013 | Sillato et al. | |
| 2016/0363359 | A1 * | 12/2016 | Lin | F25B 41/00 |
| 2017/0042067 | A1 * | 2/2017 | Parizeau | G06F 1/20 |

OTHER PUBLICATIONS

Italian Search Report and Written Opinion from corresponding Italian Application No. IT201700151025 dated Sep. 17, 2018.

* cited by examiner

SCROLL COMPRESSOR WITH INTEGRATED REFRIGERANT PUMP

CROSS-REFERENCE TO RELATED APPLICATION

This application claims the benefit under 35 U.S.C. § 119 of Italian Patent Application No. IT102017000151025 filed on Dec. 29, 2017, which is hereby incorporated herein by reference in its entirety for all purposes.

BACKGROUND

Technical Field

The technical field relates generally to cooling systems, and more particularly, to a compressor used within a cooling system.

Background Discussion

Economical systems for heat removal may combine different methods for transporting heat away from an indoor space, such as a computer room, a data center, office space or personal space. For instance, heat exchange between indoor and outdoor spaces can be facilitated using different transport fluids and cooling devices.

One example of a method for heat removal combines an air-cooled computer room air conditioner (CRAC) with a condenser, and is typically referred to as an air-cooled CRAC DX system. The "DX" designation stands for direct expansion and refers to any system that uses refrigerant and an evaporator coil to create a cooling effect. The refrigerant may be a chlorinated fluorocarbon or halogenated chlorofluorocarbon or ammonia. Air-cooled CRAC units can be used in IT environments (or other environments) and are typically configured such that half the components of the refrigeration cycle are in the CRAC and the rest are outdoors in the air-cooled condenser. Heat from the indoor environment is "pumped" to the outdoor environment using a circulating flow of refrigerant. A compressor may reside in the CRAC unit or in the condenser.

In certain cooling systems, a refrigeration cycle, sometimes referred to as a thermosiphon cycle, may be employed. In such a cycle, an additional refrigerant pump is installed outside with respect to a traditional CRAC unit. The provision of an additional refrigerant pump increases the footprint, cost and installation and maintenance time of the cooling system.

SUMMARY

Aspects and embodiments are directed to reducing size, costs and installation time for cooling systems used in a data center.

One aspect of the present disclosure is directed to a cooling system configured to operate in one of three modes, a DX mode of operation when outdoor air is too hot or too humid and the cooling system operates as a normal closed circuit system, a hybrid mode of operation when outside temperatures cool down and the cooling system operates as a partial reduced normal closed circuit system and a free cooling system, and a thermosiphon mode of operation when the outside temperature is below a predetermined temperature and the cooling system operates without the normal closed circuit system. In one embodiment, the cooling system comprises a scroll compressor unit including a main casing, a scroll compressor supported by the main casing, and a refrigerant pump supported by the main casing. The scroll compressor unit is configured to selectively engage the scroll compressor and the refrigerant pump to achieve one of the DX mode, the hybrid mode, and the thermo siphon mode.

Embodiments of the cooling system further may include configuring the main casing of the scroll compressor unit to include several ports, including an inlet compressor port, an outlet compressor port, an inlet refrigerant pump port, and an outlet refrigerant pump port. The scroll compressor unit further may include a motor supported by the main casing and configured to drive a rotation of the scroll compressor and the refrigerant pump. The motor may include a drive shaft that is connected at one end thereof to the scroll compressor to selectively drive the rotation of the scroll compressor to drive the movement of fluid injected into the scroll compressor through the inlet compressor port to and through the outlet compressor port. The drive shaft of the motor may be connected at an opposite end thereof to the refrigerant pump to selectively drive the rotation of the refrigerant pump to drive the movement of fluid injected into the refrigerant pump through the inlet refrigerant pump port to and through the outlet refrigerant pump port. The drive shaft may be connected to the scroll compressor by a first electromagnetic clutch. The drive shaft may be connected to the refrigerant pump by a second electromagnetic clutch. The cooling system further may comprise a controller to control the operational components of the cooling system, including the scroll compressor unit. In the DX mode, the first electromagnetic clutch is engaged and the second electromagnetic clutch is disengaged. In the hybrid mode, the first electromagnetic clutch is engaged and the second electromagnetic clutch is engaged. In the thermosiphon mode, the first electromagnetic clutch is disengaged and the second electromagnetic clutch is engaged.

Another aspect of the disclosure is directed to a scroll compressor unit for use in a cooling system of the type configured to operate in one of three modes, a DX mode of operation when outdoor air is too hot or too humid and the cooling system operates as a normal closed circuit system, a hybrid mode of operation when outside temperatures cool down and the cooling system operates as a partial reduced normal closed circuit system and a free cooling system, and a thermosiphon mode of operation when the outside temperature is below a predetermined temperature and the cooling system operates without the normal closed circuit system. In one embodiment, the scroll compressor comprises a main casing, a scroll compressor supported by the main casing, and a refrigerant pump supported by the main casing. The scroll compressor unit is configured to selectively engage the scroll compressor and the refrigerant pump to achieve one of the DX mode, the hybrid mode, and the thermosiphon mode.

Embodiments of the scroll compressor further may include configuring the main casing to include several ports, including an inlet compressor port, an outlet compressor port, an inlet refrigerant pump port, and an outlet refrigerant pump port. The scroll compressor further may comprise a motor supported by the main casing and configured to drive a rotation of the scroll compressor and the refrigerant pump. The motor may include a drive shaft that is connected at one end thereof to the scroll compressor to selectively drive the rotation of the scroll compressor to drive the movement of fluid injected into the scroll compressor through the inlet compressor port to and through the outlet compressor port, and is connected at an opposite end thereof to the refrigerant pump to selectively drive the rotation of the refrigerant pump to drive the movement of fluid injected into the refrigerant pump through the inlet refrigerant pump port to and through the outlet refrigerant pump port. The drive shaft may be connected to the scroll compressor by a first electromagnetic clutch, and is connected to the refrigerant pump by a second electromagnetic clutch. The scroll compressor further may comprise a controller to control the operational components of the cooling system, including the scroll compressor unit. In the DX mode, the first electromagnetic clutch may engage and the second electromagnetic clutch is disengaged. In the hybrid mode, the first electromagnetic clutch is engaged and the second electromagnetic clutch is engaged. In the thermosiphon mode, the first electromagnetic clutch is disengaged and the second electromagnetic clutch is engaged.

Still other aspects, embodiments, and advantages of these example aspects and embodiments, are discussed in detail below. Moreover, it is to be understood that both the foregoing information and the following detailed description are merely illustrative examples of various aspects and embodiments, and are intended to provide an overview or framework for understanding the nature and character of the claimed aspects and embodiments. Embodiments disclosed herein may be combined with other embodiments, and references to "an embodiment," "an example," "some embodiments," "some examples," "an alternate embodiment," "various embodiments," "one embodiment," "at least one embodiment," "this and other embodiments," "certain embodiments," or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF DRAWINGS

Various aspects of at least one embodiment are discussed below with reference to the accompanying figures, which are not intended to be drawn to scale. The figures are included to provide an illustration and a further understanding of the various aspects and embodiments, and are incorporated in and constitute a part of this specification, but are not intended as a definition of the limits of any particular embodiment. The drawings, together with the remainder of the specification, serve to explain principles and operations of the described and claimed aspects and embodiments. In the figures, each identical or nearly identical component that is illustrated in various figures is represented by a like numeral. For purposes of clarity, not every component may be labeled in every figure. In the figures:

DETAILED DESCRIPTION

Cooling systems for removing heat in conditioned spaces, such as IT environments, office space and personal space, use heat transport fluids, such as air, water, or refrigerant, to transport heat energy from indoors to outdoors. Many cooling systems rely on the refrigeration cycle as the primary means of cooling. Pumped refrigerant systems provide isolation between the primary heat removal system and IT equipment. The direct air and indirect air methods rely on the outdoor conditions as the primary means of cooling, which makes them more efficient for mild climates.

Although the examples discussed herein refer to an IT environment, the methods and system discussed in this disclosure may be applied to any confined space (also referred to herein as a "conditioned space"), such as a room, inside a building or other structure that contains air to be cooled. For example, the space to be cooled may be one or more rooms in a public or private building, such as a private residence, office space, or other commercial or municipal space, or may include spaces within an industrial or manufacturing complex. Furthermore, more than one cooling unit (such as the DX evaporator and CW coil discussed below) may be used for cooling.

In some embodiments, the space being cooled is a data center or IT environment. A data center may include one or more rooms or spaces that contain rows of equipment racks designed to house electronic equipment, such as data processing, networking, and telecommunications equipment. During operation the electronic equipment generates heat that needs to be removed to ensure the continued performance, reliability, and useful life of the equipment components housed by the equipment racks. One or more embodiments of the systems disclosed herein are designed to remove heat produced by the electronic equipment within the data center and return cool air back to the data center.

Figure 1:
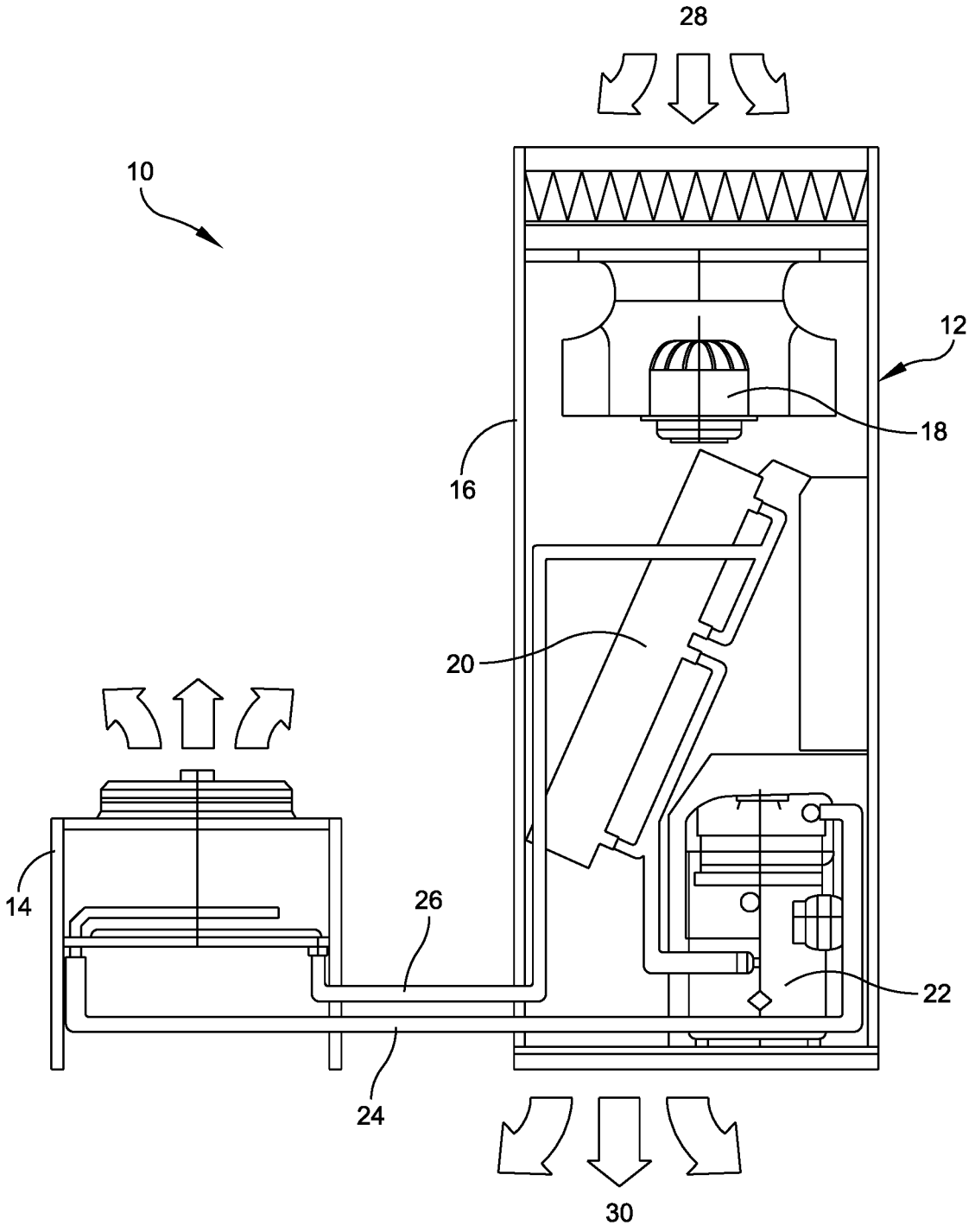
FIG. 1 is a schematic view of an exemplary cooling system.

Referring to FIG. 1, an exemplary system of removing heat from an indoor environment, such as a data center, is generally indicated at 10. As shown, the system 10 includes a CRAC DX unit, generally indicated at 12, which can be positioned inside the indoor environment, e.g., between equipment racks in a data center, and a condenser 14, which is positioned outside the indoor environment. The use of "DX" identifies direct expansion and although this term often refers to an air-cooled system, in fact any system that uses refrigerant and an evaporator coil can be called a DX system. In the shown system, most of the components of the refrigeration cycle are in the CRAC DX unit 12 and the remaining components are outdoors in the condenser 14.

In one embodiment, the CRAC DX unit 12 includes a housing 16, a fan 18 positioned at the top of the housing, a heat exchanger 20 positioned below the fan within the housing, and a compressor 22 positioned at the bottom of the housing. The arrangement is such that warm air from the indoor environment is drawn through an opening at the top of the housing 16 by the fan 18. The warm air passes through the heat exchanger 20, e.g., an evaporator, in which refrigerant contained within the heat exchanger is heated to a gaseous state. The relatively cool air is exhausted from the housing 16 of the CRAC DX unit 12 through an opening in the bottom of the unit. The refrigerant circulates between the CRAC DX unit 10 and the condenser 14 through pipes 24, 26, which sometimes are referred to as refrigerant lines. Heat from the indoor environment is "pumped" to the outdoor environment using this circulating flow of refrigerant through pipe 24. In this type of system, the compressor 22 resides in the housing 16 of the CRAC unit 12.

The system illustrated in FIG. 1 can achieve one of three operating modes. In a first operation mode, the cooling system 10 uses DX cooling provided by the heat exchanger 20 of the CRAC DX unit 12 to cool the indoor environment. This can also be referred to herein as a "mechanical mode"

or "DX mode" of operation. The mechanical mode may be implemented when outdoor air is too hot or too humid to support the IT inlet set point and this mode operates as a normal closed circuit system. Hot air from the indoor environment enters the system at 28, and passes over the heat exchanger 20 of the CRAC DX unit 12 under the influence of fan 18. Conditioned air (cooled air) exits the system at 30, and is introduced to the indoor environment, e.g., the IT space, to cool the indoor environment. Heat transport fluid leaving the CRAC DX unit 12 is in a low pressure gas state and is compressed to a hot, highly pressurized gas by the compressor 22 and sent to the condenser 14.

In a second operating mode, referred to herein as a "hybrid mode" of the cooling system 10, as outside temperatures cool down, heat transfer fluid may be implemented for at least partial "free cooling" of the hot indoor air. In hybrid mode, both the CRAC DX unit 12 and the condenser 14 contribute to cooling. Heat transfer fluid flows in the self-contained circuit as described in greater detail below. Hot air from the indoor environment can thus be cooled first by the CRAC DX unit 12. Heat transfer fluid expels heat through the condenser 14. In the hybrid mode, the CRAC DX unit 12 can be operated at a lower setting than in the mechanical mode, which reduces the energy consumption for the cooling system 10. For instance, less energy is used by the compressor in the refrigerant loop containing heat transfer fluid.

In a third operating mode the cooling system 10, which can be referred to as a "thermosiphon mode" of operation, free cooling may be used in instances where the outside temperature is sufficiently low enough to cool the heat transfer fluid to a degree that is capable of cooling the indoor air to a set point temperature without using the CRAC DX unit 12. The cooling system 10 bypasses CRAC DX unit 12 and uses refrigerant from the compressor 22 for cooling. Heat transport fluid is cooled by external air and is used to cool hot indoor air as it passes through the CRAC DX unit 12. Heat from the indoor air is transferred to the heat transport fluid, which is then expended through condenser 14.

Figure 2:
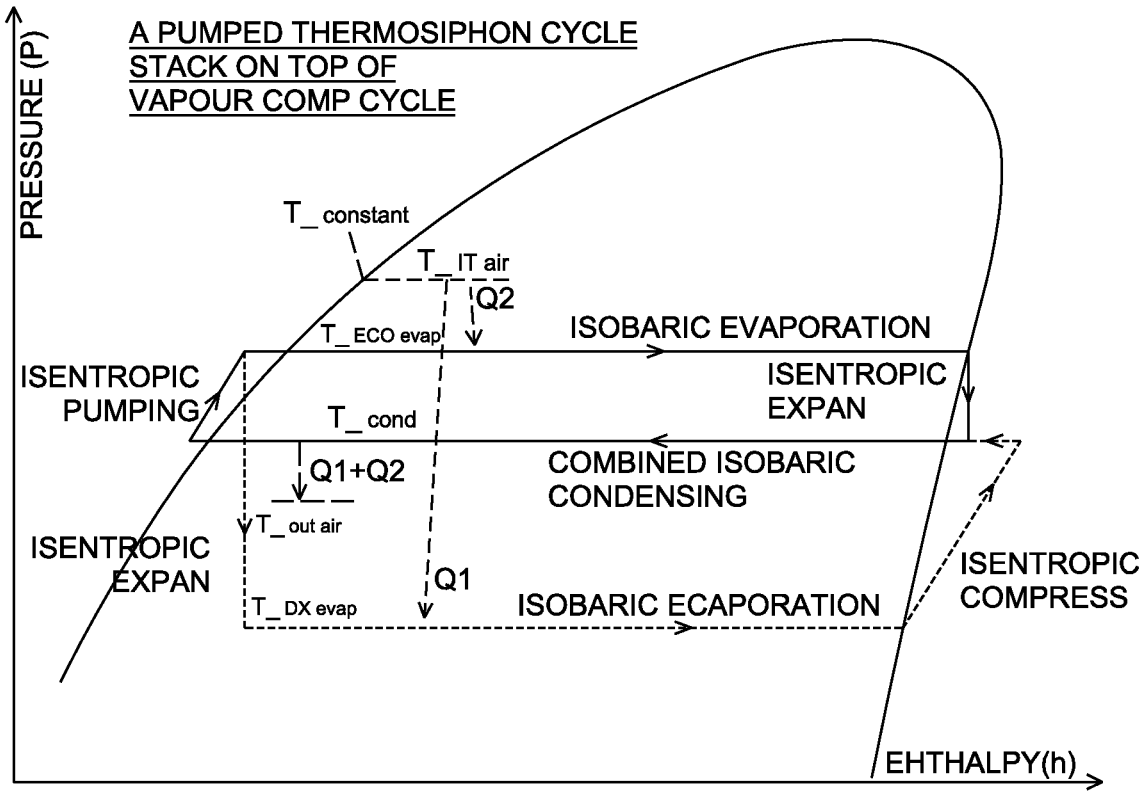
FIG. 2 is a graph showing a pumped thermosiphon cycle disposed on top of a vapor compression cycle.

FIG. 2 illustrates a pumped thermosiphon cycle stacked on top of a vapor compression cycle. As referred to herein, thermosiphon is a method of passive heat exchange, based on natural convection, which circulates a fluid with a mechanical pump. Thermosiphoning is used for circulation of liquids and volatile gases in heating and cooling applications. This circulation can either be open loop, as when the substance in a holding tank is passed in one direction via a heated transfer tube mounted at the bottom of the tank to a distribution point or it can be a vertical closed loop circuit with return to the original container. Its purpose is to simplify the transfer of liquid or gas while avoiding the cost and complexity of an additional conventional pump. Vapor-compression refrigeration refers to a cycle in which the refrigerant undergoes phase changes to provide air conditioning for a space. Refrigeration may be broadly defined as lowering the temperature of an enclosed space by removing heat from that space and transferring it elsewhere.

Figure 3:
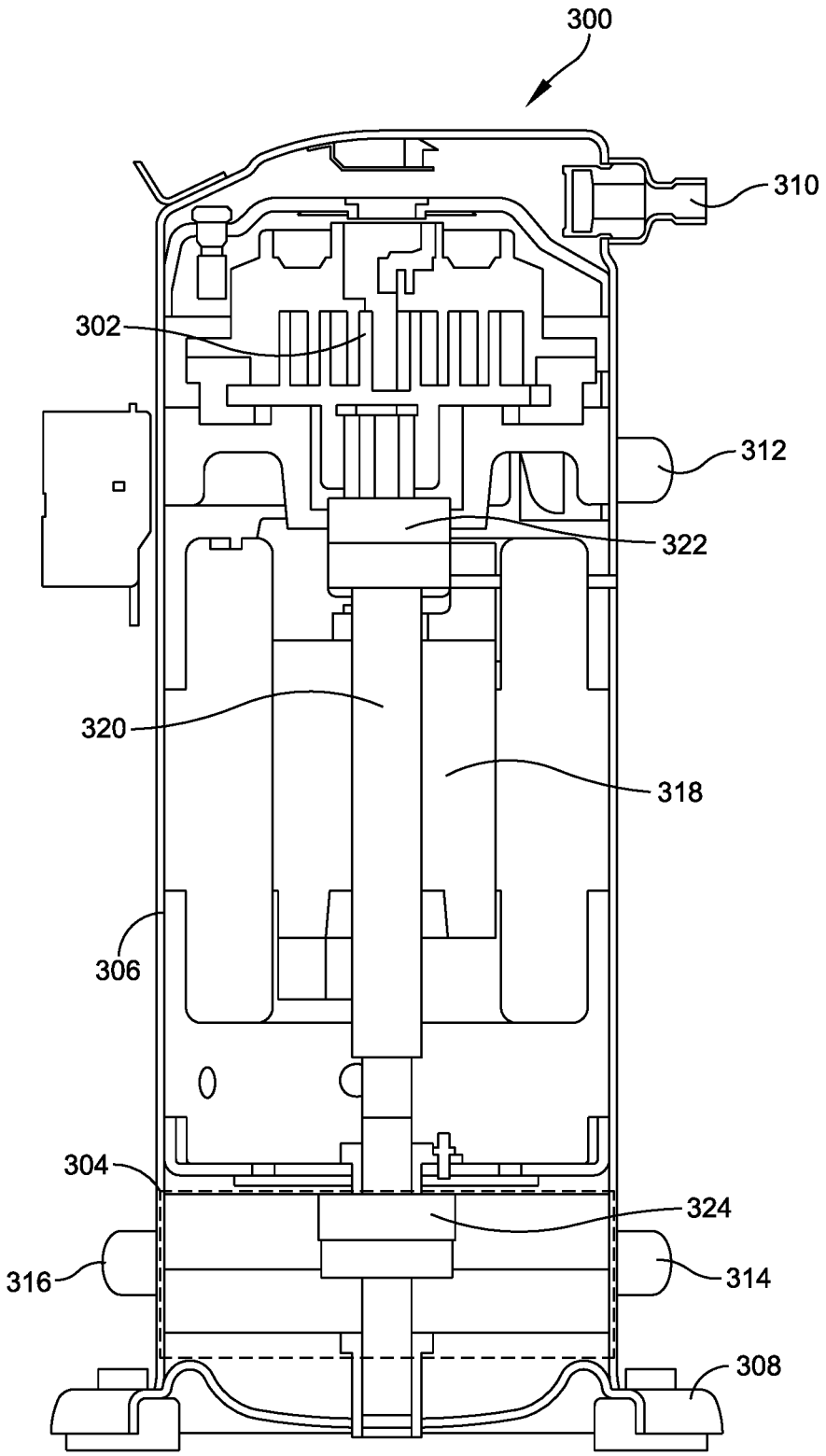
FIG. 3 is a sectional view of a scroll compressor of the cooling system of an embodiment of the present disclosure.

Referring to FIG. 3, embodiments of the present disclosure include a scroll compressor unit, generally indicated at 300, having an integrated refrigerant pump. The scroll compressor unit 300 of embodiments of the present disclosure can be used in place of compressor 22 of system 10. The scroll compressor unit 300 with integrated refrigerant pump incorporates two components currently used to manage the refrigerant cycle represented in the FIG. 2, with a refrigerant scroll compressor 302 and a refrigerant pump 304 integrated in a single device.

In one embodiment, the modified scroll compressor unit 300 can initially employ an Emerson Copeland 3-horsepower AC compressor sold under Model No. ZP38K5E-TFD. The scroll compressor 302, which can also be referred to as a spiral compressor, a scroll pump or a scroll vacuum pump, is an apparatus configured to compress a medium, such as refrigerant. A typical scroll compressor includes to interleaving scrolls that are designed to compress the refrigerant. In one embodiment, one of the scrolls is fixed, while the other scroll orbits eccentrically without rotating to compress the refrigerant between the scrolls. In another embodiment, the scrolls rotate in synchronous motion with offset centers of rotation.

Scroll compressors, such as scroll compressor 302, operate more smoothly, quietly, and reliably than traditional compressors in some applications. The compression process occurs over approximately 2 to 2½ rotations of a crankshaft, compared to one rotation for rotary compressors, and one-half rotation for reciprocating compressors. The discharge and suction processes of the scroll compressor occur for a full rotation, compared to less than a half-rotation for a reciprocating suction process, and less than a quarter-rotation for the reciprocating discharge process of a traditional compressor. Reciprocating compressors have multiple cylinders (from two to six), while scroll compressors only have one compression element. As result, scroll compressors are nearly 100% volumetrically efficient in pumping the trapped fluid. Moreover, since scroll compressors have fewer moving parts than reciprocating compressors, scroll compressors have better reliability. Scroll compressors are compact due to their small shell enclosures which reduce overall cost but also results in smaller volume.

As discussed above, the scroll compressor unit 300 includes the scroll compressor 302 and the integrated refrigerant pump 304. A shown, the scroll compressor unit further includes a main casing or housing 306, which, in one embodiment is cylindrical in construction. The main casing 306 is sized to support the components of the scroll compressor unit 300. In one embodiment, the main casing 306 is secured on a base 308, which can be mounted on a suitable horizontal surface. The main casing 306 includes several ports, which include an inlet compressor port 310, an outlet compressor port 312, an inlet refrigerant pump port 314, and an outlet refrigerant pump port 316. The purpose of these ports will be described in greater detail as the description of the scroll compressor proceeds.

The scroll compressor unit 300 further includes a brushless motor 318 positioned within the main casing 306 of the scroll compressor unit. The motor 318 includes a drive shaft 320 that is connected at one end thereof to the scroll compressor 302 by a first electromagnetic clutch 322 to selectively drive the rotation of the scroll compressor. The arrangement is such that the scroll compressor 302 drives the movement of fluid injected into the scroll compressor through the inlet compressor port 310 to and through the outlet compressor port 312. The drive shaft 320 of the motor 318 is connected at an opposite end thereof to the refrigerant pump 304 by a second electromagnetic clutch 324 to selectively drive the rotation of the refrigerant pump. The arrangement is such that the refrigerant pump 304 drives the movement of fluid injected into the refrigerant pump through the inlet refrigerant pump port 314 to and through the outlet refrigerant pump port 316.

As mentioned above, the cooling system 10 operates on one of three modes, the DX mode, the hybrid mode and the thermosiphon mode. When in the DX mode, the first electromagnetic clutch 322 is engaged and the second electromagnetic clutch 324 is disengaged. Thus, the scroll compressor 302 is driven by the brushless motor 318 as in a traditional scroll compressor and the refrigeration cycle implemented is that represented by the vapor compression cycle in FIG. 2.

When in the hybrid mode, the first electromagnetic clutch 322 is engaged and the second electromagnetic clutch 324 is engaged as well. Thus, both scroll compressor 302 and refrigerant pump 304 are driven by the same brushless motor 318 and the refrigeration cycle implemented is the combination of two cycles represented by the vapor compression cycle and the pumped thermosiphon cycle in FIG. 2.

When in the thermosiphon mode, the first electromagnetic clutch 322 is disengaged and the second electromagnetic clutch 324 is engaged. Thus, the integrated refrigerant pump 304 is driven by brushless motor 318 as a traditional refrigerant pump and the refrigeration cycle implemented is that represented by the pumped thermosiphon cycle in FIG. 2.

Figure 4:
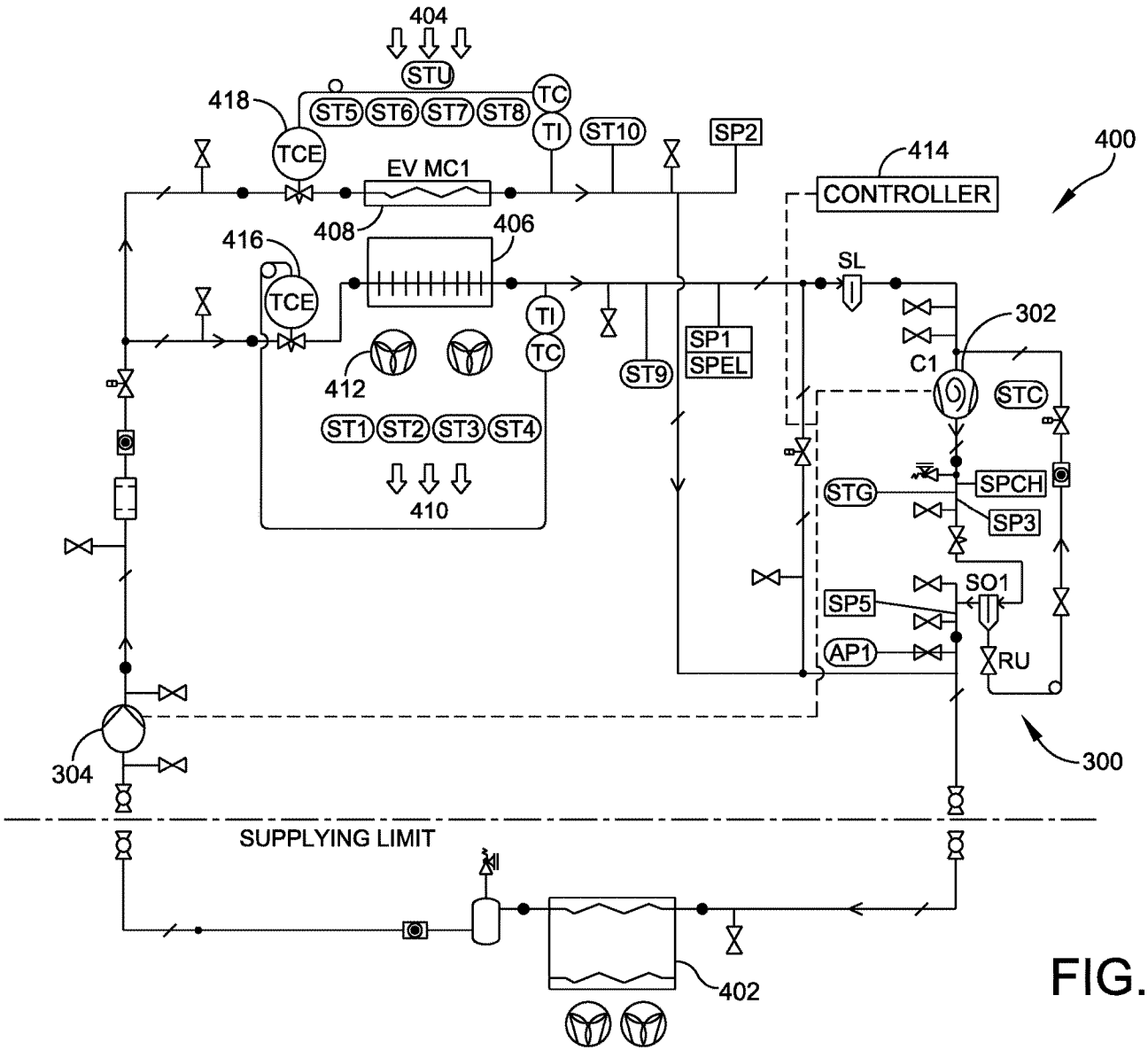
FIG. 4 is a schematic diagram of the cooling system embodying the scroll compressor.

An embodiment of a cooling system, generally indicated at 400, employing the scroll compressor unit 300 is shown in FIG. 4. Although separated from one another in FIG. 4, the scroll compressor 302 and the refrigerant pump 304 are consolidated within the main casing 306 of the scroll compressor unit 300 shown in FIG. 3. The dotted line that joins the scroll compressor 302 and the refrigerant pump 304 in FIG. 4 represents the mechanical connection of these two components in a single device (i.e., main casing 306). As shown, the scroll compressor 302, when the first electromagnetic clutch 322 is engaged, drives refrigerant to a condenser 402 positioned outside the location of the scroll compressor unit 300. The DX mode is initiated when outdoor air is too hot or too humid to support the IT inlet set point. Hot air from the IT environment enters the system at 404, and passes over the cooling coils of a first evaporator 408. Conditioned air exits the system at 410 and is introduced to the IT space using one or more fans 412 and is used to cool the IT space. Heat transport fluid leaving the first evaporator 406 is in a low pressure gas state by a thermal expansion valve 416 and is compressed to a hot, highly pressurized gas by the scroll compressor 302 and passed to the heat exchanger condenser 402 in which the hot refrigerant condenses to a liquid, and the cycle repeats itself. A controller 414 is provided to control the operation of the components of the cooling system 400, including the scroll compressor unit 300, and related valves and thermal expansion valves associated with the cooling system.

In the hybrid mode, as outside temperatures cool down, heat transfer fluid may be implemented for at least partial "free cooling" of the hot IT air 404. In hybrid mode, both the first evaporator 406 and a second evaporator 408 contribute to cooling since the first electromagnetic clutch 322 and the second electromagnetic clutch 324 are engaged. Hot air 404 from the IT environment can thus be cooled first by the second evaporator 408 and then by the first evaporator 406 such that the second evaporator assists the first evaporator. Heat transfer fluid expels heat through the condenser 402. In the hybrid mode, the second evaporator 408 can be operated at a lower setting than in the mechanical mode, which reduces the energy consumption for the cooling system 400. For instance, less energy is used by the scroll compressor 302 in the refrigerant loop containing heat transfer fluid. As with the first heat exchanger 406, heat transport fluid leaving the second evaporator 408 is in a low pressure gas state by a thermal expansion valve 418. The heat transport fluid is compressed to a hot, highly pressurized gas by the refrigerant pump 304 and passed back to the heat exchanger 408 in which the cycle repeats itself.

In the thermosiphon mode, free cooling is used where the outside temperature is sufficiently low enough to cool the heat transfer fluid to a degree that is capable of cooling the hot IT air 404 to a set point temperature without using the first evaporator 406. In thermosiphon mode, the first electromagnetic clutch 322 is disengaged and the second electromagnetic clutch 324 is engaged. The thermal expansion valve 416 is closed and the thermal expansion valve 418 is open so that hot gas from the pump 304 enters the second evaporator 408 and uses only second evaporator 408 for cooling. Heat transport fluid is cooled by external air and is used to cool hot IT air as it passes through the second evaporator 408. Heat from the IT air 404 is transferred to the heat transport fluid in the second evaporator 408, which is then directed to the condenser 402.

Thus, it should be observed that the scroll compressor unit of embodiments of the present disclosure integrates two components, the scroll compressor and the refrigerant pump, into one unit. This enables the use of one motor, instead of two, to drive the operation of the scroll compressor and the refrigerant pump. This further enables the provision of a single control device, instead of two separate control devices, to control the operation of the scroll compressor and the refrigerant pump. The result is a scroll compressor unit that is more compact, reduces cost, is easier to install, and is easier to produce and manufacture.

The aspects disclosed herein in accordance with the present invention, are not limited in their application to the details of construction and the arrangement of components set forth in the following description or illustrated in the accompanying drawings. These aspects are capable of assuming other embodiments and of being practiced or of being carried out in various ways. Examples of specific implementations are provided herein for illustrative purposes only and are not intended to be limiting. In particular, acts, components, elements, and features discussed in connection with any one or more embodiments are not intended to be excluded from a similar role in any other embodiments.

Also, the phraseology and terminology used herein is for the purpose of description and should not be regarded as limiting. Any references to examples, embodiments, components, elements or acts of the systems and methods herein referred to in the singular may also embrace embodiments including a plurality, and any references in plural to any embodiment, component, element or act herein may also embrace embodiments including only a singularity. References in the singular or plural form are not intended to limit the presently disclosed systems or methods, their components, acts, or elements. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. In addition, in the event of inconsistent usages of terms between this document and documents incorporated herein by reference, the term usage in the incorporated reference is supplementary to that of this document; for irreconcilable inconsistencies, the term usage in this document controls.

Having thus described several aspects of at least one example, it is to be appreciated that various alterations, modifications, and improvements will readily occur to those skilled in the art. For instance, examples disclosed herein may also be used in other contexts. Such alterations, modifications, and improvements are intended to be part of this disclosure, and are intended to be within the scope of the examples discussed herein. Accordingly, the foregoing description and drawings are by way of example only.

What is claimed is:

1. A cooling system configured to operate in one of three modes, a DX mode of operation when outdoor air is too hot or too humid, a hybrid mode of operation when outside temperatures cool down, and a thermosiphon mode of operation when the outside temperature is below a predetermined temperature, the cooling system comprising:

a scroll compressor unit including a main casing, a compressor supported by the main casing, a refrigerant pump supported by the main casing; and a motor supported by the main casing and configured to drive a rotation of the compressor and the refrigerant pump, the motor including a drive shaft that is connected at one end thereof to the compressor to selectively drive the rotation of the compressor and connected at an opposite end thereof to the refrigerant pump to selectively drive the rotation of the refrigerant pump, wherein the drive shaft is connected to the compressor by a first electromagnetic clutch and connected to the refrigerant pump by a second electromagnetic clutch, wherein the scroll compressor unit is configured to selectively engage the compressor and the refrigerant pump to achieve one of the DX mode, the hybrid mode, and the thermosiphon mode, wherein if the DX mode is selected among the three modes of the cooling system such that the cooling system selectively engages the DX mode, the first electromagnetic clutch is engaged and the second electromagnetic clutch is disengaged, and wherein if the hybrid mode is selected among the three modes of the cooling system such that the cooling system selectively engages the hybrid mode, the first electromagnetic clutch is engaged and the second electromagnetic clutch is engaged.

2. The cooling system of claim 1, wherein the main casing of the scroll compressor unit includes several ports, including an inlet compressor port, an outlet compressor port, an inlet refrigerant pump port, and an outlet refrigerant pump port.

3. The cooling system of claim 2, wherein the motor, when selectively driving the rotation of the compressor, drives the movement of fluid injected into the compressor through the inlet compressor port to and through the outlet compressor port.

4. The cooling system of claim 3, wherein the motor when selectively driving the rotation of the refrigerant pump drives the movement of fluid injected into the refrigerant pump through the inlet refrigerant pump port to and through the outlet refrigerant pump port.

5. The cooling system of claim 1, further comprising a controller to control operational components of the cooling system, including the scroll compressor unit.

6. The cooling system of claim 1, wherein if the thermosiphon mode is selected among the three modes of the cooling system such that the cooling system selectively engages the thermosiphon mode, the first electromagnetic clutch is disengaged and the second electromagnetic clutch is engaged.

7. A scroll compressor unit for use in a cooling system configured to operate in one of three modes, a DX mode of operation when outdoor air is too hot or too humid, a hybrid mode of operation when outside temperatures cool down, and a thermosiphon mode of operation when the outside temperature is below a predetermined temperature, the scroll compressor unit comprising:

a main casing;

a scroll compressor supported by the main casing;

a refrigerant pump supported by the main casing; and a motor supported by the main casing and configured to drive a rotation of the compressor and the refrigerant pump, the motor including a drive shaft that is connected at one end thereof to the compressor to selectively drive the rotation of the compressor and connected at an opposite end thereof to the refrigerant pump to selectively drive the rotation of the refrigerant pump, wherein the drive shaft is connected to the compressor by a first electromagnetic clutch and connected to the refrigerant pump by a second electromagnetic clutch, wherein the scroll compressor unit is configured to selectively engage the scroll compressor and the refrigerant pump to achieve one of the DX mode, the hybrid mode, and the thermosiphon mode, wherein if the DX mode is selected among the three modes of the cooling system such that the cooling system selectively engages the DX mode, the first electromagnetic clutch is engaged and the second electromagnetic clutch is disengaged, and wherein if the hybrid mode is selected among the three modes of the cooling system such that the cooling system selectively engages the hybrid mode, the first electromagnetic clutch is engaged and the second electromagnetic clutch is engaged.

8. The scroll compressor unit of claim 7, wherein the main casing includes several ports, including an inlet compressor port, an outlet compressor port, an inlet refrigerant pump port, and an outlet refrigerant pump port.

9. The scroll compressor unit of claim 8, wherein the motor, when selectively driving the rotation of the compressor, drives the movement of fluid injected into the compressor through the inlet compressor port to and through the outlet compressor port, and when selectively driving the rotation of the refrigerant pump, drives the movement of fluid injected into the refrigerant pump through the inlet refrigerant pump port to and through the outlet refrigerant pump port.

10. The scroll compressor unit of claim 7, further comprising a controller to control the operational components of the cooling system, including the scroll compressor unit.

11. The scroll compressor unit of claim 7, wherein if the thermosiphon mode is selected among the three modes of the cooling system such that the cooling system selectively engages the thermosiphon mode, the first electromagnetic clutch is disengaged and the second electromagnetic clutch is engaged.

* * * * *